United States Patent [19]

Ehrenfried

[11] 4,456,247

[45] Jun. 26, 1984

[54] LEG STRETCHING APPARATUS

[76] Inventor: Ted R. Ehrenfried, 10 Evans Cir., Poquoson, Va. 23662

[21] Appl. No.: 362,561

[22] Filed: Mar. 26, 1982

[51] Int. Cl.[3] ..... A63B 23/04

[52] U.S. Cl. ..... 272/126; 272/134; 272/144; 128/25 R

[58] Field of Search ..... 273/84 R; 272/70, 72, 272/93, 126–145; 128/25, 25 R, 69–75

[56] References Cited

U.S. PATENT DOCUMENTS

| | | | |
|---|---|---|---|
| 2,058,563 | 10/1936 | Campbell | 128/75 |
| 2,512,911 | 6/1950 | Benice | 272/72 |
| 3,189,344 | 6/1965 | Swarts | 272/126 |
| 3,481,198 | 12/1969 | Williams | 272/130 X |
| 3,756,595 | 9/1973 | Hague | 272/135 X |
| 4,125,258 | 11/1978 | McArthur | 272/144 X |
| 4,149,713 | 4/1979 | McLeod | 272/130 X |
| 4,277,062 | 7/1981 | Lawrence | 272/126 |

FOREIGN PATENT DOCUMENTS

| | | | |
|---|---|---|---|
| 1083705 | 9/1967 | United Kingdom | 272/72 |

OTHER PUBLICATIONS

"Black Belt"; May 1980; Feb. 1982, p. 17.

*Primary Examiner*—Richard J. Apley

*Assistant Examiner*—Chris Coppens

*Attorney, Agent, or Firm*—Ferguson, Baker, Whitham, Spooner & Kroboth

[57] ABSTRACT

Disclosed are two separate leg supporting members which are independently pivotally connected to a base assembly. At their pivotal connection with the base assembly they are further provided with a disk assembly having a cable attached thereto. The cable from each leg supporting member is attached through guide means to a crank assembly which, during operation, forces the leg supporting members apart stretching the legs of a user of a device into a "split" position. The crank assembly housing is pivotally mounted such that when the housing is moved forward and/or rearward, the cable path of both cables is lengthened a small amount, providing the user with a controlled minute additional stretching movement. The leg supporting members during non-use are retractable partially into the base assembly and a torso retaining seat back assembly can be folded flat. The crank housing assembly can also be folded down on top of the seat back assembly providing a very compact storage configuration. In a preferred embodiment, a friction brake device is affixed to the crank assembly such that the user can straighten his legs away from the "split" position, thus strengthening his leg muscles as well as stretching them.

14 Claims, 5 Drawing Figures

LEG STRETCHING APPARATUS

BACKGROUND OF THE INVENTION

The present invention relates generally to athletic equipment and relates specifically to a leg stretching apparatus.

Dancers, gymnasts, marshal arts practitioners, and others are oftentimes called upon to perform an exercise which involves the spreading apart of one's legs into a so-called "split" position, in which the person's torso is either sitting or reclining and the legs are pointing at essentially right angles to the torso and 180 degrees with respect to each other. This maneuver requires a great deal of flexibility which is generally achieved through various stretching exercises. Oftentime, such exercises utilize the individual's body weight to force the legs into a progressively wider stance. It is very difficult to control the application of force when using one's body weight while relaxing the muscles to be stretched at the same time. Consequently, many people over-stretch the muscles actually tearing muscles and ligaments, causing, at a minimum, very painful injuries.

In the past, various types of leg stretching devices have been used. In marshal arts training, it is desirable to be able to extend one's leg over one's head in a kick. Various devices are currently marketed which utilize a strap located around the individual's foot and connected to a cable going to a pulley located above the individual. Pulling on the cable will stretch the individual's foot at progressively greater distances above the ground. Obviously, the trainee must maintain his balance standing on one foot while at the same time attempting to relax the leg muscles and also pull on the rope raising the leg. Obviously, this presents the expected problems and also serves to apply substantial pressure to the trainee's knee joint with possible damage thereto.

Another device currently on the market permits the operator to sit on the device with each leg being independently supported. The leg supporting devices are pivotally attached to the central portion of the machine upon which the individual is seated. Cables extend from the outer portion of the leg supporting devices through pulleys at the rear of the machine and from there forward to a crank and drum assembly. As the crank is wound the cables are tightened, pulling the leg supporting members towards the rear of the machine, forcing the user's legs into a "split" position. There are numerous disadvantages with this type of machine, however. Because of the location of the pulley and cable arrangement extending to the rear of the machine, the legs cannot be conveniently folded into the body of the machine to provide a compact storage position. Additionally, from both a safety and aesthetic viewpoint, it is desirable to eliminate exposed cables connecting the leg supports to the rear of the frame. Finally, and most importantly, the prior art device depends upon hand cranking the winch assembly to provide adjustments in the stretch force applied to the legs. Thus, only relatively large-scale adjustments can be made, even when the near maximum muscle stretch position has been obtained. Thus, the risk of injury from such a device is comparatively high.

SUMMARY OF THE INVENTION

Therefore, in view of the above and other disadvantages of prior art leg stretching apparatuses, it is an object of the present invention to provide a leg stretching apparatus in which all cables are concealed within the base and/or crank assembly of the device.

It is a further object of the present invention to provide a leg stretching apparatus in which pulleys previously located at the rear portion of the base can be eliminated, allowing leg support members to be folded into the base for compact storage.

An additional object of the present invention is to provide a leg stretching apparatus utilizing a crank assembly for providing large-scale stretching movement of leg supports and to provide a further apparatus for applying minute and contolled stretching movements to the leg supports once the near maximum muscle stretch position has been reached.

It is an additional object of the present invention to provide a leg stretching apparatus which not only supports the entire leg while undergoing stretching, but also can be folded into a relatively compact assembly which can be easily transported.

It is an additional object of the present invention to provide a collapsible leg stretching apparatus in which any cables present are concealed within the base and crank assembly of the device and which is capable of applying minute and controlled rotational forces to the operator's legs at least when a near maximum muscle stretch position has been reached.

The above and other objects are achieved in accordance with the present invention by providing a torso restraining member in the form of a seat and pivotally mounting two leg supporting members thereto. Each of the leg supports in a preferred embodiment has a disk segment attached thereto with a groove in the outer periphery thereof. A cable is attached to the disk such that when the cable is pulled towards the forward direction (away from the user), the leg support is pivoted rearward towards the "split" position. In a preferred embodiment, the torso restraining member conceals the cable and disk assembly from view.

The cables from each disk assembly pass through a guide and go up to a conventional crank and drum assembly which provides the major amount of cable movement, moving the leg supports towards the "split" position when the crank is operated. However, the crank assembly is pivotally mounted on the base for movement fore and aft. Rollers are provided in the pivotal mount such that when the crank housing is moved either foward and/or rearward, the cable path is lengthened a slight amount. Thus, tilting the crank assemby fore and aft will cause minute and controlled movements of the leg supports towards the "split" position. When not in use, the crank assembly housing can be tilted flat against the seat portion and the leg supports can be pivoted to the rear and folded into and around the body of the apparatus.

BRIEF DESCRIPTION OF THE DRAWINGS

A more complete appreciation of the invention, and many of the attendant advantages thereof, will be readily apparent by reference to the accompanying drawings, wherein.

DETAILED DESCRIPTION OF PREFERRED EMBODIMENTS

Figure 1:
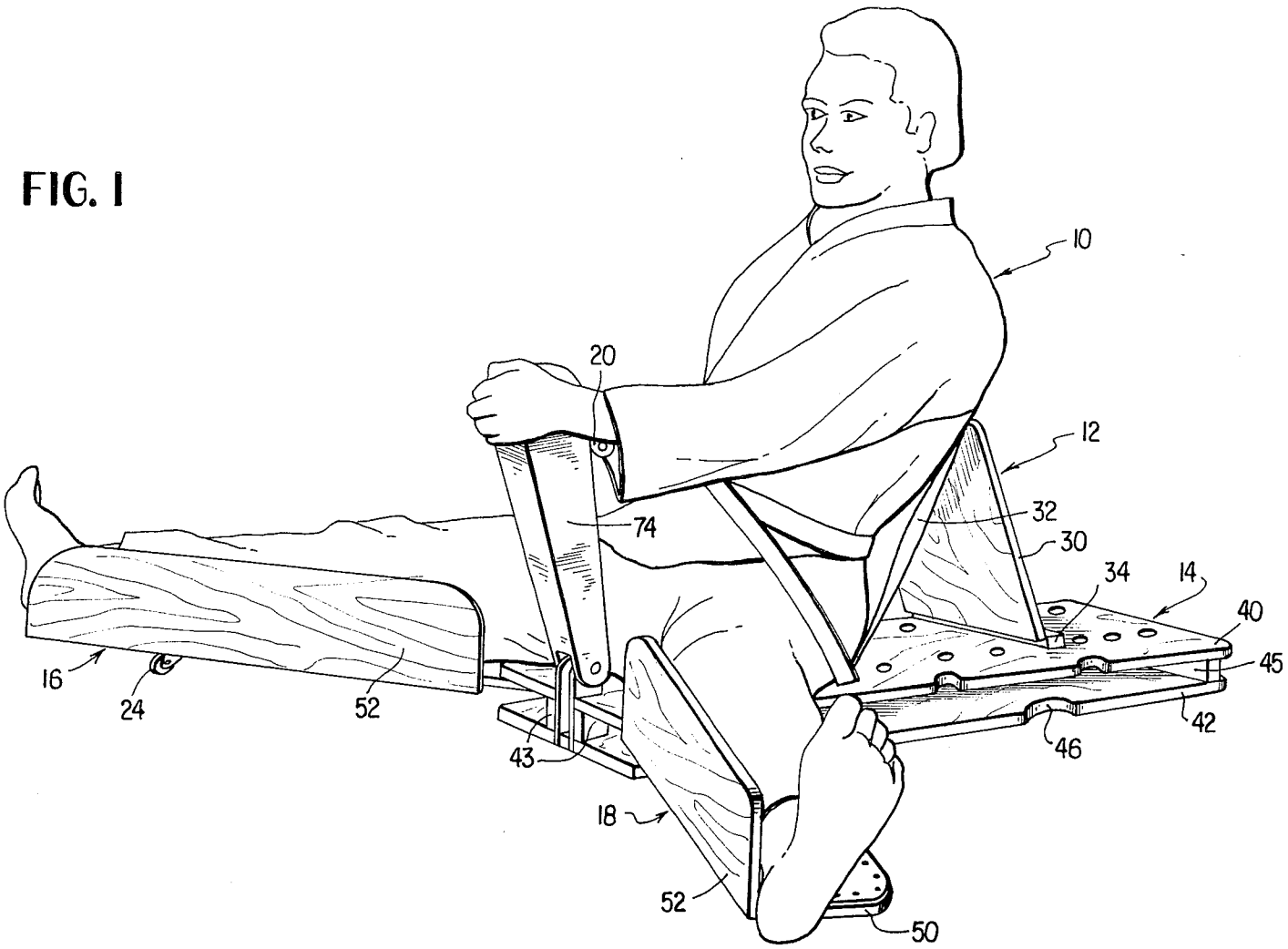
FIG. 1 is a perspective view of an individual using the present invention.

Referring now more particularly to the drawings, wherein like numerals represent like elements throughout the several views, FIG. 1 generally shows the operator position and use of the leg stretching apparatus. The operator 10 is seated on the torso restraining means comprised of seat assembly 12 and base assembly 14. The legs are placed in the leg supporting means 16 and 18, which are spread apart through the action of crank 20 and crank assembly housing 22, as will be seen more clearly in later figures. Movement of the leg supporting means is aided through use of a wheel means 24 and 26.

The seat assembly 12 is comprised of two generally planar portions 30 and 32 which, in a preferred embodiment, are connected by a hinge along their contact point (not shown). In a preferred embodiment, the lower edge of the planar portions of the seat are connected to transverse mounting bars 34 and 36. Each bar in the embodiment shown has some protruding device, in this instance, a wooden dowel 38, which fits into corresponding holes in the base assembly. These dowels prevent movement of the seat assembly along the surface of the base assembly, and also permit adjustment of the seat back both in position and tilt to suit the operator's needs.

Figure 2:
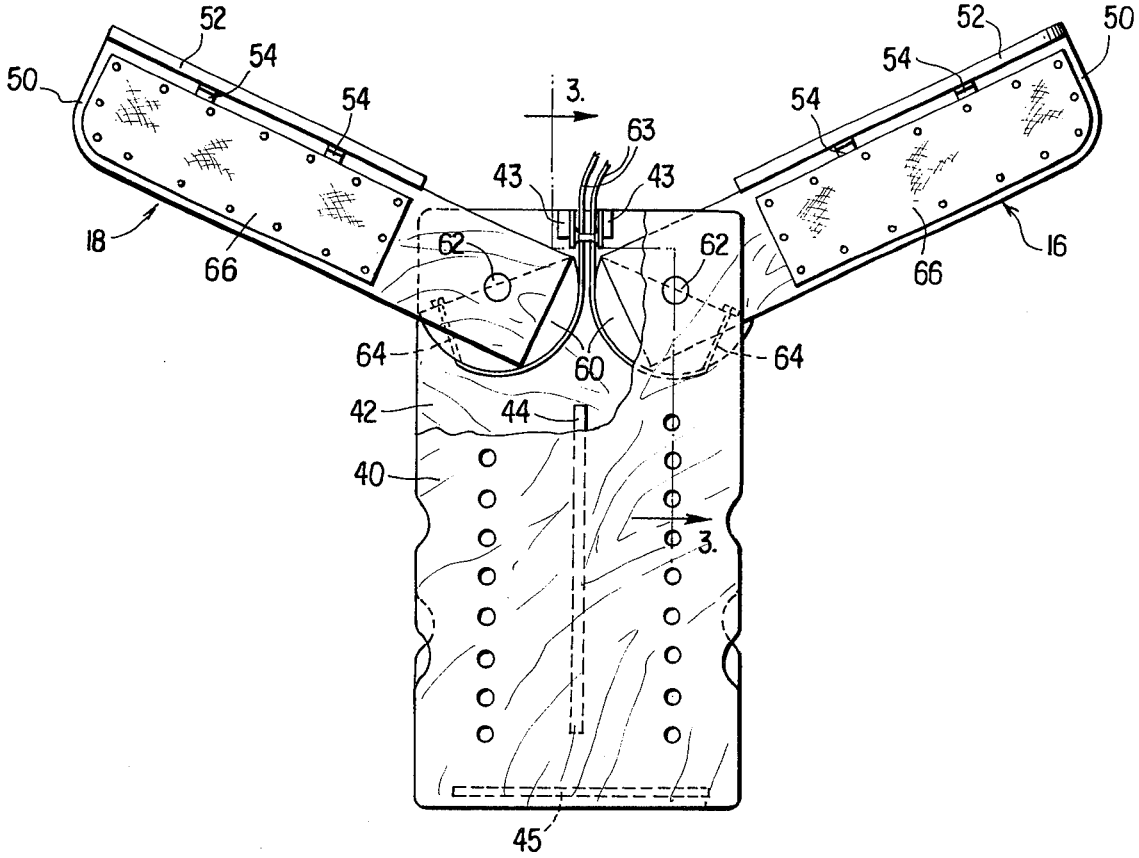
FIG. 2 is a top elevational view showing the details of the torque disk and cable assembly with a portion of the upper body being cut away.

In a preferred embodiment, the base assembly is made up of upper and lower portions, 40 and 42, respectively. Their spaced-apart relationship is maintained in a preferred embodiment by spacers 43, 44 and 45, as can be seen in FIGS. 1 and 2. In a preferred embodiment, notches 46 are formed in the lower base portion 42 to accommodate the wheel means 24 when the leg supporting means are pivoted back into the storage position.

Each leg supporting means comprises a horizontal, longitudinally extending portion 50 and a vertical, longitudinally extending portion 52. In a preferred embodiment, the vertical portion is attached to the horizontal portion by means of hinges 54, which can be more clearly seen in FIGS. 2 and 5. By reference to FIG. 5, it can be seen that a rather substantial gap is provided between the vertical portion and the horizontal portion when the leg supporting means is in the folded position (the right-hand portion of FIG. 5) to accommodate the thickness of the upper base portion 40 and the seat assembly 12 when folded flat. This ability to fold the leg supporting means partially into the base assembly and then to fold the vertical, longitudinally extending portions to a horizontal position permits the present invention to be stored in a very small space. It can also be seen that when the vertical portion 52 is in its operating position, it is in direct contact with the horizontal portion 50, providing a relatively rigid connection as far as resisting the pressure of the legs during operation of the apparatus.

By reference to FIG. 2, the orientation of the torque disks 60 to the leg supporting means 16, 18 can be seen. In a preferred embodiment, the torque disk comprises a disk portion which is fixably secured to the horizontal portion 50 of the leg supporting means. The torque disk and horizontal portion assembly is pivotally mounted by means of pivots 62, which extends through and between the upper and lower base portions, 40 and 42, respectively. Each torque disk has a groove along at least a portion of the outer periphery of the torque disk so as to accept cables 63 therein. In a preferred embodiment, a hole 64 is drilled in the torque disk, the cable 63 inserted therethrough with a fitting swaged or otherwise attached to the end of the cable to prevent it from being completely withdrawn through hole 64. Thus, it can be seen when the ends of cable 63 are pulled towards the top of FIG. 2, both leg supporting means will be rotated towards the rear of the seat assembly, i.e., forcing the operator's legs towards the "split" position. For comfort of the operator, the vertical and horizontal portions of the leg supporting means may be padded with a vinyl and foam layer 66, as shown in FIG. 2. This same material can also be used effectively to provide a comfortable cover for the seat and base assembly where the operator's lower torso is in contact therewith as shown in FIG. 3.

Figure 3:
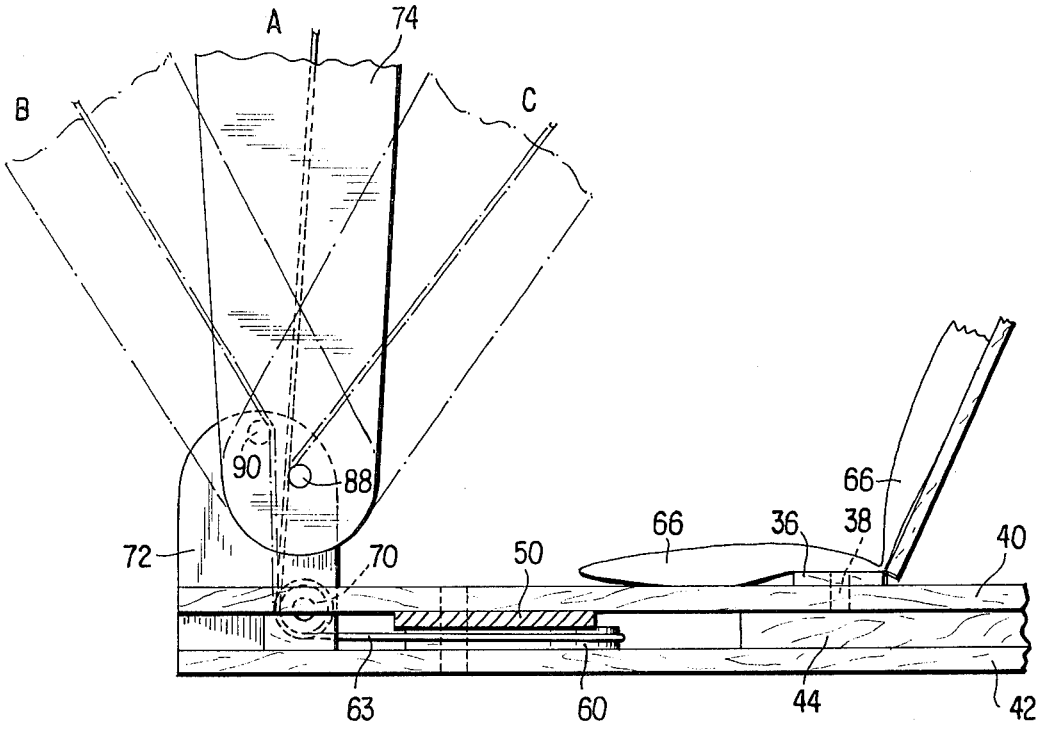
FIG. 3 is a side view, partially in section, of FIG. 2 taken along section lines 3—3.
Figure 4:
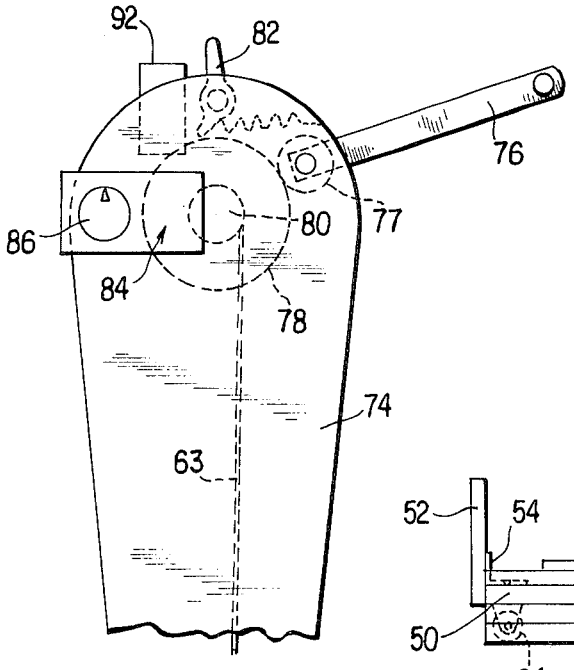
FIG. 4 is a side view of the upper portion of the crank assembly housing.

By reference to FIG. 3, the operation of the torque disk 60, which is connected to the horizontal portion 50 of leg supporting means 16, can be more clearly seen. The cable runs through a guide means 70 which is attached through mount 72 to the base assembly. After passing around guide means 70, both cables travel to the crank assembly, as shown more clearly in FIG. 4.

The crank assembly housing 74 houses a conventional winch for tightening cable 63. A crank handle, upon rotation, rotates small gear 77 which, in turn, rotates larger gear 78, which causes drum 80 to pull on cable 63 extending from guide means 70. A simple spring-biased ratchet 82 controllably prevents unwinding of cable 63 from drum 80 when the crank handle 76 is released. In one embodiment, a friction brake 84 bears upon a portion of the crank assembly (the larger gear 78 as shown) to provide resistance to the withdrawing of cable 63 from the drum when ratchet 82 is released. The amount of friction, and thus the amount of force on cable 63 necessary to unwind it from drum 80, can be adjusted by means of adjustment 86, to allow the user of the device not only to stretch his leg muscles but also to exercise them by forcing the leg supports together in the non-"split" position. Such adjustable friction brakes are known in the art and can be adapted to the crank assembly housing in a conventional manner in view of the previous discussion. Counter 92 comprises a means for indicating to the operator the amount of movement of the leg supporting means.

As previously noted, once the user of apparatus has cranked the leg supporting means into a near maximum-stretch position, it is desirable to be able to increase the stretch in very small controlled increments. This is accomplished according to the present invention by pushing forward and/or pulling back on the crank assembly housing 74. Returning to FIG. 3, the crank assembly housing 74 is pivotally mounted on mount 72 by pivot 88. This permits the entire crank assembly housing to be pivoted from its generally vertical position as shown by letter A forward to the dotted line position B and rearward to the dotted line position C. Roller means are provided upon which the cables may bear when the crank assembly housing is pushed or pulled into the "B" or "C" positions. In a preferred embodiment, pivot 88 is a roller means when the housing is deflected into position "C" and a separate roller means 90 is provided to deflect the cables during movement of the assembly housing to position "B". It can be seen that when the cable is forced to travel around either roller means, the path that the cable travels from the drum 80 to the guide means 70 will be increased a very small amount. Thus, the cable will be pulled from the torque disk towards the guide means 70, this small amount causing a small and controlled additional stretching movement of the leg supporting means.

Thus, the operator, once he has cranked the leg supporting means into a nearly maximum stretch position, can tilt the cable assembly housing forward or rearward to add a slightly additional amount of stretch to his legs. Because the amount added is very small in relation to the movement of the control housing, there is no danger that a large amount of leg stretching movement will inadvertently be added, as is the case with only crank-actuated devices.

Figure 5:
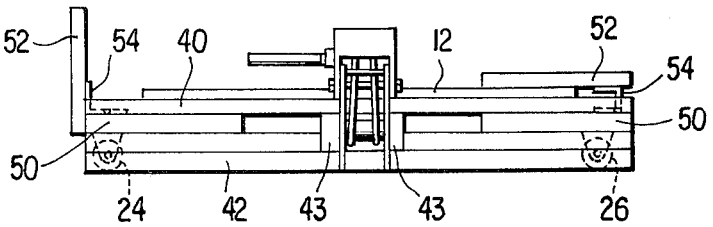
FIG. 5 is a front end view of the present invention in the partially folded condition.

As has been previously noted, when the apparatus is not being used, it can be stored in a very compact manner, as shown in FIG. 5, by folding the leg supporting means rearward such that the horizontal portion fits into the space between the upper and lower base portions and the vertical portion is folded flat, holding the seat assembly in place in its flat condition. Finally, the crank assembly housing 74 is folded back to the rear, providing a very compact and easily stored configuration to the leg stretching device. Depending on the ultimate user of such a device, many different materials could be used for the upper and lower base portions, the vertical and horizontal leg supporting portions, and the torque disk and seat assembly portions. Such materials would include wood, fiberboard, plastics, fiberglas, aluminum, and/or metal materials, as well as others which will become obvious to those of ordinary skill in view of the previous discussion. It is also clear that the geometry of the crank assembly, the ratchet, and the friction brake (if desired) could be changed substantially without departing from the spirit of the present invention. Additionally, the geometry of the pivoting crank assembly housing could be changed depending upon how much cable travel would be desired for a given angular displacement of the crank assembly housing. Additionally, although the torque disks were circular and were mounted to pivot about their center of curvature, it will be seen that non-circular perimeters could be used on the torque disks and/or they could be mounted away from their centure of curvature. This would provide a variation in the amount of leg stretch per crank actuation, depending upon how close the user was to the "split" position. Furthermore, although the use of cables, torque disks, and the crank assembly are preferred embodiments of the present invention, it is well within the skill of those in the art to substitute a simple gear drive in place thereof, in view of the present disclosure. Therefore, and in view of the above teachings, many modifications and applications of the invention will be obvious to those of ordinary skill in the art. The invention is not limited to the specific examples and embodiments expressed herein, and is limited only in accordance with the appended claims.

The embodiments of the invention in which an exclusive property or privilege is claimed are defined as follows:

1. A leg stretching apparatus for stretching the legs of a person into a "split" condition, said leg stretching apparatus comprising:

a lower torso retaining means for retaining the lower torso of the person using the apparatus; and means for providing a leg stretching movement, said movement having a component directed rearward of said person tending to spread said person's legs apart, said leg stretching movement providing means including crank means operative for providing a first leg stretching movement and user controlled adjustment means for providing a second leg stretching movement, said adjustment means comprising a means for adjusting the leg stretching movement independent of said crank means operation.

2. The apparatus according to claim 1, wherein said leg stretching movement providing means comprises:

two elongate leg supporting means, one for each leg of said person using the leg stretching apparatus;

means for pivotally mounting each of said leg supporting means to said torso retaining means for movement in a generally horizontal plane;

means for housing a crank assembly; and means for pivotally mounting said crank assembly housing means to said torso retaining means for pivotal movement in a generally vertical plane.

3. The apparatus according to claim 2, wherein each of said leg supporting means includes a cable, and a cable mounting means, mounting one end of said cable, for generating said leg stretching movement when said cable is pulled, said other end of each of said cables being connected to said crank means, the operation of said crank means pulling on said cable.

4. The apparatus according to claim 3, wherein said leg stretching movement providing means further includes guide means for redirecting said cables from a generally horizontal plane to a generally vertical plane, and said crank assembly housing pivotal mounting means located substantially intermediate said guide means and said crank means.

5. The apparatus according to claim 4, wherein said adjustment means comprises:

roller means, located substantially intermediate said guide means and said crank means, for lengthening the cable path from said guide means to said crank means when said crank assembly housing means is pivoted away from an initial position.

6. The apparatus according to claim 5, wherein said housing means pivots in the forward and rearward directions, said initial position is a substantially vertical orientation of said housing means, and said roller means comprises:

a first roller means, fixed with respect to said guide means and located just forward of said cables from said guide means to said crank means when said housing means is in said initial position, for contacting said cable when said housing means is pivoted in said forward direction; and a second roller means, fixed with respect to said guide means and located just rearward of said cables from said guide means to said crank means when said housing means is in said initial position, for contacting said cables when said housing means is pivoted in said rearward direction.

7. The apparatus according to claim 6, wherein said second roller means comprises said pivotal mounting means.

8. The apparatus according to claim 1, wherein said lower torso retaining means includes a seat and backrest assembly.

9. The apparatus according to claim 7, wherein each of said leg supporting means includes a horizontal, longitudinally extending portion and said cable mounting means comprises a portion of a disk, said disk portion affixed to said horizontal, longitudinally extending portion, said center of said disk portion coincident with said leg supporting means pivot, each of said disk portions including means defining a groove around at least a portion of the periphery of said disk, said groove mounting said cable.

10. The apparatus according to one of claims 6 or 9, wherein each of said leg supporting means includes a generally horizontal, longitudinally extending member, a generally vertical, longitudinally extending member, and hinge means, connecting said members, permitting said vertical member to fold into a generally horizontal plane during storage.

11. The apparatus according to claim 10, wherein each of said generally horizontal, longitudinally extending members are supported at one end by a disk portion, said leg supporting means further including roller means, located on said horizontal member, intermediate said ends, for permitting said horizontal member to pivot freely about said leg supporting means' pivot axis.

12. The apparatus according to claim 1, wherein there is further included means for indicating the amount of movement of said provided means to said person.

13. A leg stretching apparatus in accordance with claim 1, wherein said means for providing a leg stretching movement comprises means cantilevered from said lower torso retaining means for providing said leg stretching movement.

14. A leg stretching apparatus for stretching the legs of a person into a "split" condition, said leg stretching apparatus comprising:

a lower torso retaining means for retaining the lower torso of the person using the apparatus; and means for providing a leg stretching movement, said movement having a component directed rearward of said person tending to spread said person's legs apart, said leg stretching movement providing means including means for providing an initial leg stretch position and user controlled adjustment means for providing a leg stretching movement, said adjustment means comprising a means for adjusting the leg stretching movement independent of the operation of said means for providing an initial leg stretch position.

* * * * *